US009963898B2

(12) United States Patent
Li

(10) Patent No.: US 9,963,898 B2
(45) Date of Patent: May 8, 2018

(54) UNDERWATER CLEANING ROBOT

(71) Applicant: Ningbo Pulefei Intelligent Technology Co., Ltd, Ningbo (CN)

(72) Inventor: Weimin Li, Huaian (CN)

(73) Assignee: Ningbo Pulefei Intelligent Technology Co., Ltd, Ningbo (CN)

( * ) Notice: Subject to any disclaimer, the term of this patent is extended or adjusted under 35 U.S.C. 154(b) by 0 days. days.

(21) Appl. No.: 15/586,317

(22) Filed: May 4, 2017

(65) Prior Publication Data

US 2018/0002940 A1 Jan. 4, 2018

(30) Foreign Application Priority Data

Jun. 29, 2016 (CN) ..... 2016 2 0663534 U

(51) Int. Cl.
*E04H 4/16* (2006.01)

(52) U.S. Cl.
CPC ..... *E04H 4/1654* (2013.01); *E04H 4/16* (2013.01); *E04H 4/1663* (2013.01)

(58) Field of Classification Search
CPC ..... E04H 4/16; E04H 4/1654; E04H 4/1663
USPC ..... 15/1.7; 210/167.16, 167.17; 4/490, 496
See application file for complete search history.

(56) References Cited

U.S. PATENT DOCUMENTS 3,324,492 A * 6/1967 Myers ..... A47L 11/00 15/1.7
5,961,822 A * 10/1999 Polimeni, Jr. ..... E04H 4/1263 210/122
6,228,256 B1 * 5/2001 Ekenback ..... B01D 24/205 15/1.7
9,856,669 B2 * 1/2018 Hui ..... E04H 4/1654
2007/0007192 A1 * 1/2007 Reid ..... E04H 4/1636 210/269
2012/0279001 A1 * 11/2012 Fu ..... E04H 4/1654 15/1.7
2013/0152317 A1 * 6/2013 Erlich ..... B08B 9/08 15/1.7
2014/0246050 A1 * 9/2014 Klintberg ..... G21C 17/01 134/6
2016/0145884 A1 * 5/2016 Erlich ..... E04H 4/1654 15/1.7
2016/0168872 A1 * 6/2016 Hui ..... E04H 4/1663 134/21

* cited by examiner

*Primary Examiner* — Michael Jennings
(74) *Attorney, Agent, or Firm* — Gokalp Bayramoglu

(57) ABSTRACT

The present application discloses an underwater cleaning robot, which includes a chassis provided with a plurality of driving wheels. The chassis includes a primary suction port and a pump assembly. The primary suction port is provided with a channel which passes through the chassis. The chassis is connected to the filtering assembly. The filtering assembly includes a secondary pump port and a secondary suction port. The pump includes a primary pump port which is connected to the pump impeller. The secondary pump port is connected to the primary pump port. The secondary suction port is connected to the primary suction port. When assembling, the secondary suction port on the filtering assembly is in line with the primary suction port, and the secondary pump port is connected to the primary pump port. Finally, the filtering assembly is snapped into the chassis.

8 Claims, 5 Drawing Sheets

UNDERWATER CLEANING ROBOT

CROSS REFERENCE TO RELATED APPLICATIONS

This application claims priority to Chinese Patent Application No. 201620663534.7, filed on Jun. 29, 2016, the entire contents of which are incorporated herein by reference.

TECHNICAL FIELD

The present application relates to cleaning machine technology, in particular, to an underwater cleaning robot.

BACKGROUND

The underwater cleaning robot can conduct the cleaning operation without discharging the pool water, thus avoiding any hinderance in using the pool due to the operation, such that onerous work of cleaning the pool is reduced and the precious water resource is saved. Since the cleaning robot can do the cleaning work automatically, it got popular among vast consumers, and has a broad market place. However, since the capacity of the trash can of the cleaning robot is limited, after the cleaning robot works for a certain period of time, the user needs to remove the garbage and dust in the trash can manually. Thus, it is necessary to design an underwater cleaning robot which has a trash can that is easy to be detached by the user and has a good fitting accuracy and sealing.

SUMMARY

The present application solved the above technical problem. Regarding the current situation of the above prior art, an underwater cleaning robot is provided. The underwater cleaning robot has a reasonable structural configuration, a high fitting accuracy of each mechanism, steady operation, and can satisfy the requirement of frequent cleaning of the garbage.

The technical solution used by the present application to solve the above technical problem is as follows. An underwater cleaning robot includes a chassis provided with a plurality of driving wheels. The chassis includes a primary suction port and a pump assembly. The primary suction port is provided with a channel which passes through the chassis. The chassis is connected to the filtering assembly. The filtering assembly includes a secondary pump port and a secondary suction port. The pump includes a primary pump port which is connected to the pump impeller. The secondary pump port is connected to the primary pump port. The secondary suction port is connected to the primary suction port.

In order to optimize the above technical solution, measures taken further includes:

The above chassis includes a brush. The brush has a V-shape. The brush is provided behind the primary suction port.

The above chassis includes a console which is provided lengthways. The console is electrically connected to the pump assembly and the power supply. The filtering assembly includes a notch which is in a U-shape. The console is provided in the notch.

The above filtering assembly includes a filtering element, a filtering cabin, and a pump cabin. The filtering cabin is provided with the filtering element. The secondary suction port is inside the filtering element. The pump assembly is provided in pump cabin. The pump assembly includes a nozzle. The nozzle is provided with a channel which is associated with the pump impeller and the pump cabin. The filtering assembly is provided with an outlet which is associated with the pump cabin and the outside.

The above filtering assembly includes a supporting plate and an upper housing. The secondary suction port is provided on the body of the supporting plate. The upper housing covers the filtering cabin and the pump cabin. The edge contour of supporting plate is same as the lower edge contour of the upper housing. The supporting plate is clamped at the lower edge of the upper housing.

The above filtering assembly includes a positioning concave. The positioning concave is provided at the lower end face of the filtering assembly. The chassis includes a positioning convex. The positioning convex is provided on the upper end face of the chassis. The positioning convex is provided in the positioning concave. The positioning convex and the positioning concave are embedded with magnets with opposite polarities.

The above filtering assembly includes a valve plate. The valve plate covers the outlet. The valve plate is rotatably connected to the filtering assembly.

The above filtering assembly includes a plurality of wings. The plurality of wings are provided on both sides of the filtering assembly.

The above filtering assembly includes a handle which is provided on top of the filtering assembly.

The above handle and the chassis are provided at an angle of 15° to 50°.

Compared with the prior art, an underwater cleaning robot of the present application includes a chassis provided with a plurality of driving wheels. The chassis includes a primary suction port and a pump assembly. The primary suction port is provided with a channel which passes through the chassis. The chassis is connected to the filtering assembly. The filtering assembly includes a secondary pump port and a secondary suction port. The pump includes a primary pump port which is connected to the pump impeller. The secondary pump port is connected to the primary pump port. The secondary suction port is connected to the primary suction port. When assembling, the secondary suction port on the filtering assembly is in line with the primary suction port, and the secondary pump port is connected to the primary pump port. Finally, the filtering assembly is snapped to the chassis. The operation principle of the present application: the sewage enters the secondary suction port through the primary suction port, and then enters the filtering assembly to be filtered. Filtered and treated water passes through the secondary pump port and is pumped back to the pool by the pump assembly. Advantages of the present application are as follows. The user can independently and easily disassemble, assemble, and clean the underwater cleaning robot. Moreover, the underwater cleaning robot has the characteristics of reasonable structural configuration, the high fitting accuracy of each mechanism, and steady operation.

DETAILED DESCRIPTION

Figure 1:
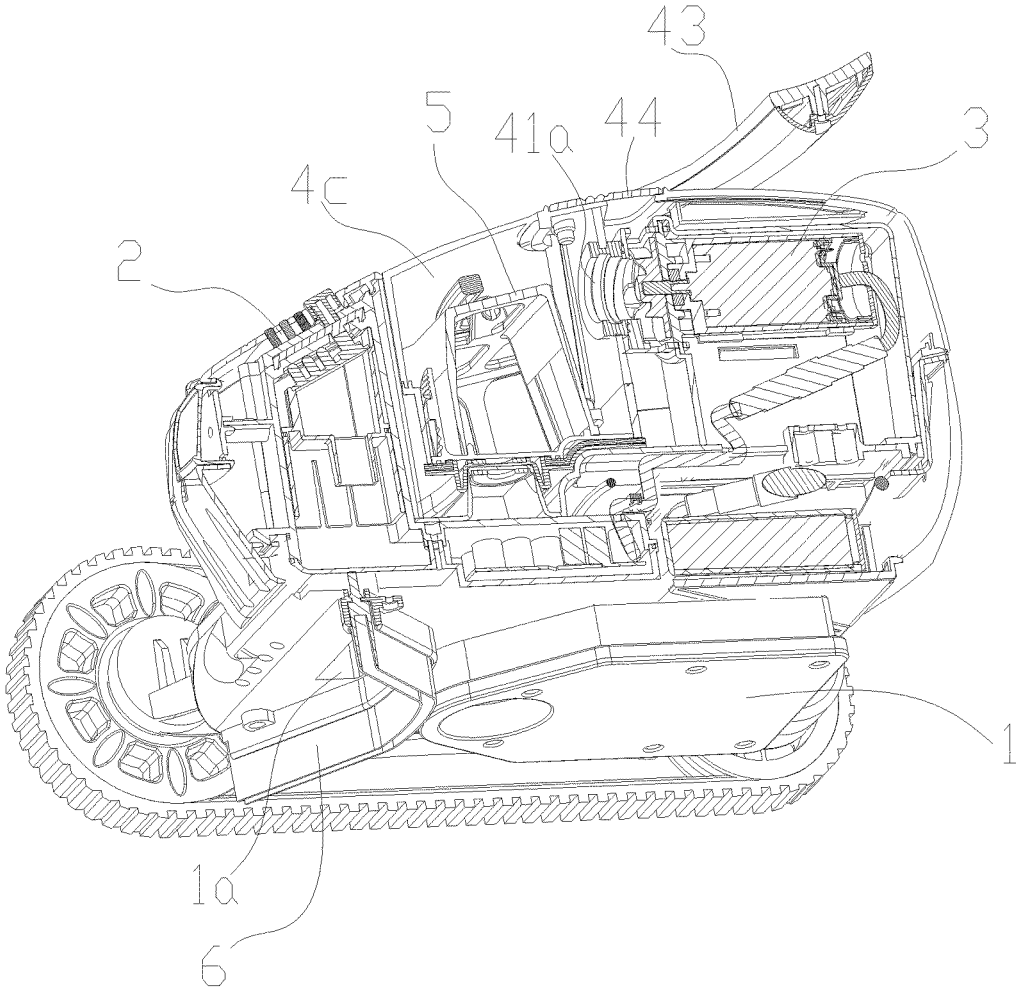
FIG. 1 is the full sectional structural schematic diagram of the present application.

Hereinafter, embodiments of the present application are further described in detail with reference to the drawings.

FIG. 1 to FIG. 5 are structural schematic diagrams of the present application.

Reference symbols in the drawings: 1 chassis, 1*a* primary suction port, 1*b* positioning convex, 2 console, 3 pump assembly, 31 primary pump port, 32 nozzle, 4 filtering assembly, 4*a* notch, 4*b* pump cabin, 4*c* filtering cabin, 4*e* positioning concave, 41 upper housing, 41*a* secondary pump port, 42 supporting plate, 42*a* secondary suction port, 43 handle, 44 valve plate, 45 outlet, 46 wing, 5 filtering element, 6 brush.

FIG. 1 to FIG. 5 are structural schematic diagrams of the present application. As shown in the figures, an underwater cleaning robot of the present application includes a chassis 1 provided with a plurality of driving wheels. Chassis 1 includes primary suction port 1*a* and pump assembly 3. Primary suction port 1*a* is provided with a channel which passes through chassis 1. Chassis 1 is connected to filtering assembly 4. Filtering assembly 4 includes secondary pump port 41*a* and secondary suction port 42*a*. The pump includes primary pump port 31 which is connected to the pump impeller. Secondary pump port 41*a* is connected to primary pump port 31. Secondary suction port 42*a* is connected to primary suction port 1*a*. The sewage in the pool enters secondary suction port 42*a* through primary suction port 1*a*, and then enters filtering assembly 4 to be filtered. After being filtered, the treated water passes through secondary pump port 41*a*, and is pumped back to the pool by pump assembly 3.

In the embodiment, as shown in FIG. 1, chassis 1 includes brush 6. Brush 6 which is in a V-shape is provided behind primary suction port 1*a*. V-shaped brush 6 can collect particle dirt in primary suction port 1*a*, so as to expand the cleaning range of primary suction port 1*a*.

Figure 2:
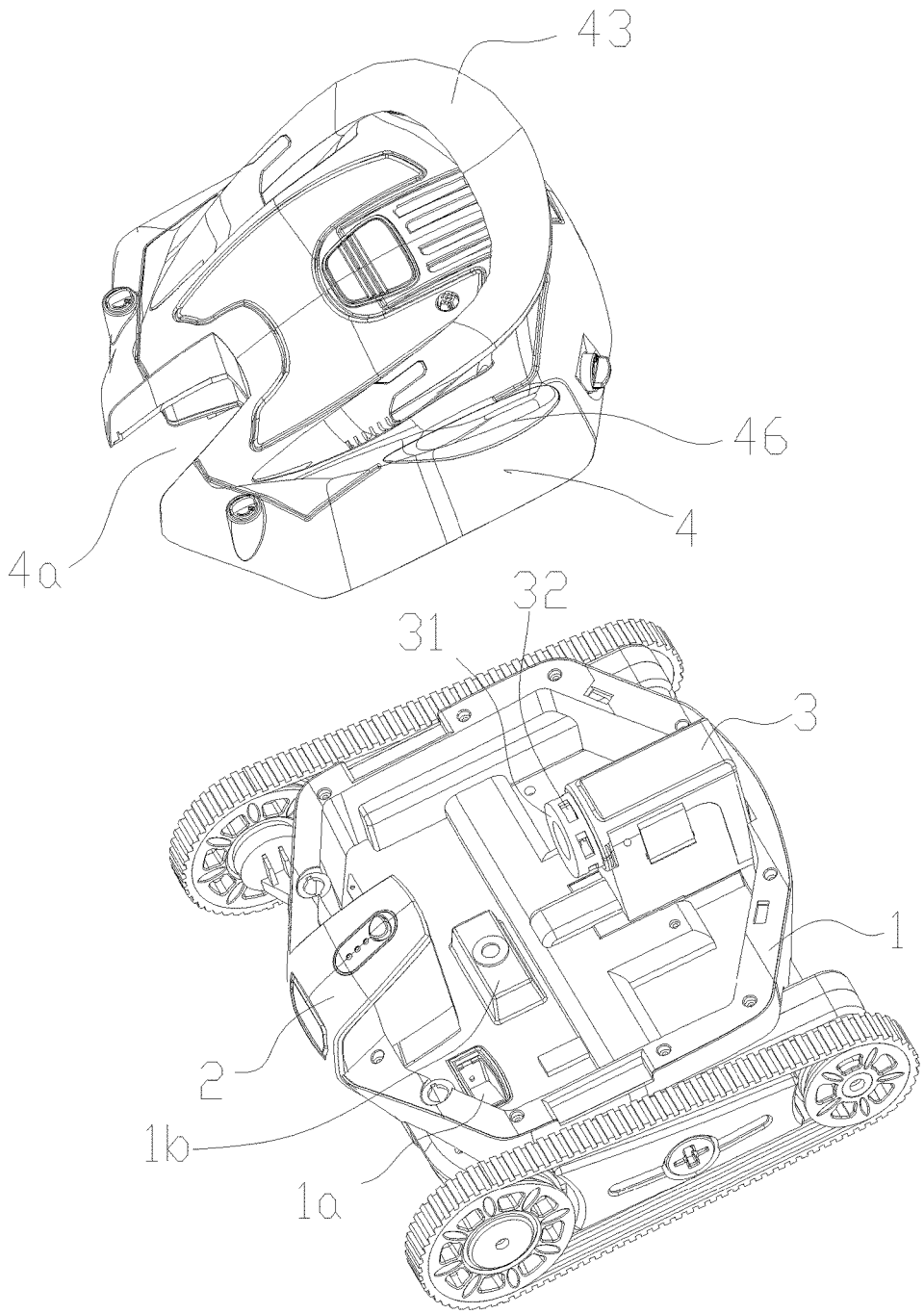
FIG. 2 is the explosive view of the present application.
Figure 3:
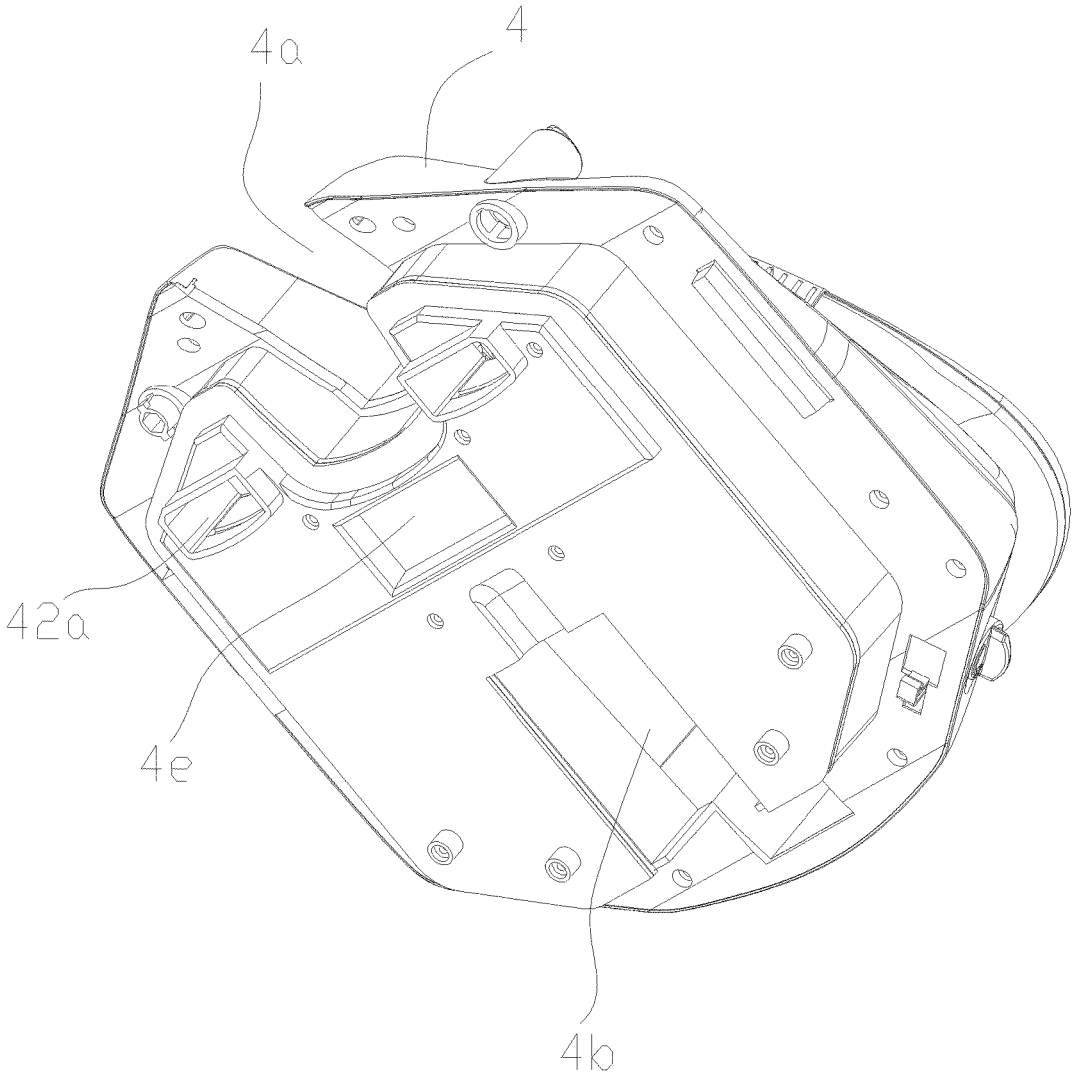
FIG. 3 is the structural schematic diagram of the filtering assembly in FIG. 2.

In the embodiment, as shown in FIG. 2 and FIG. 3, chassis 1 includes console 2 provided lengthways. Console 2 is electrically connected to pump assembly 3 and the power supply. Filtering assembly 4 includes notch 4*a* which is provided in a U-shape. Console 2 is provided in notch 4*a*. When assembling, notch 4*a* of filtering assembly 4 is in line with the inserted console 2. Meanwhile, pump cabin 4*b* is in line with pump assembly 3. Finally, filtering assembly 4 is laid down as a whole, such that filtering assembly 4 is snapped to chassis 1. The dissembling process is contrary to the assembling process.

Figure 4:
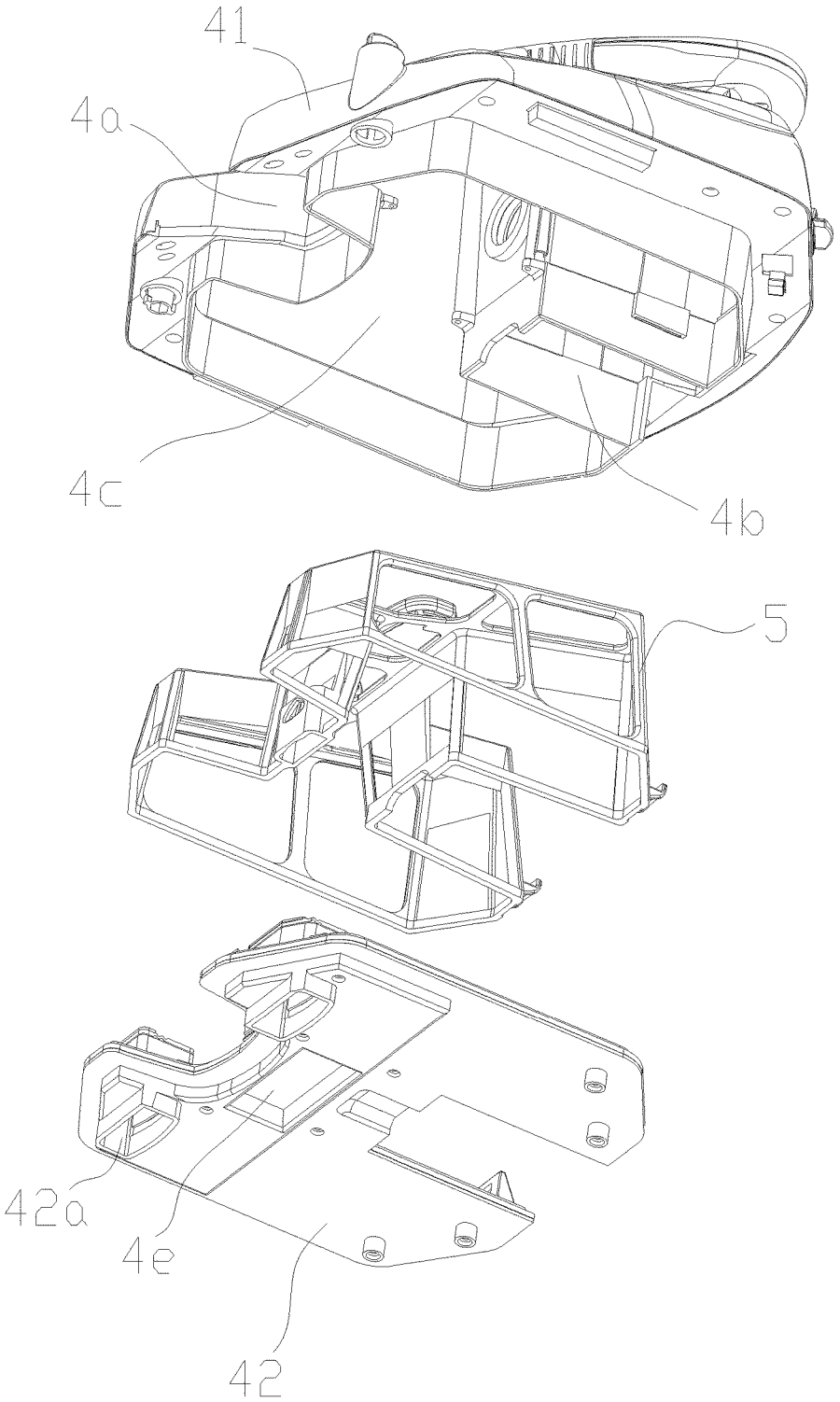
FIG. 4 is the explosive view of FIG. 3.
Figure 5:
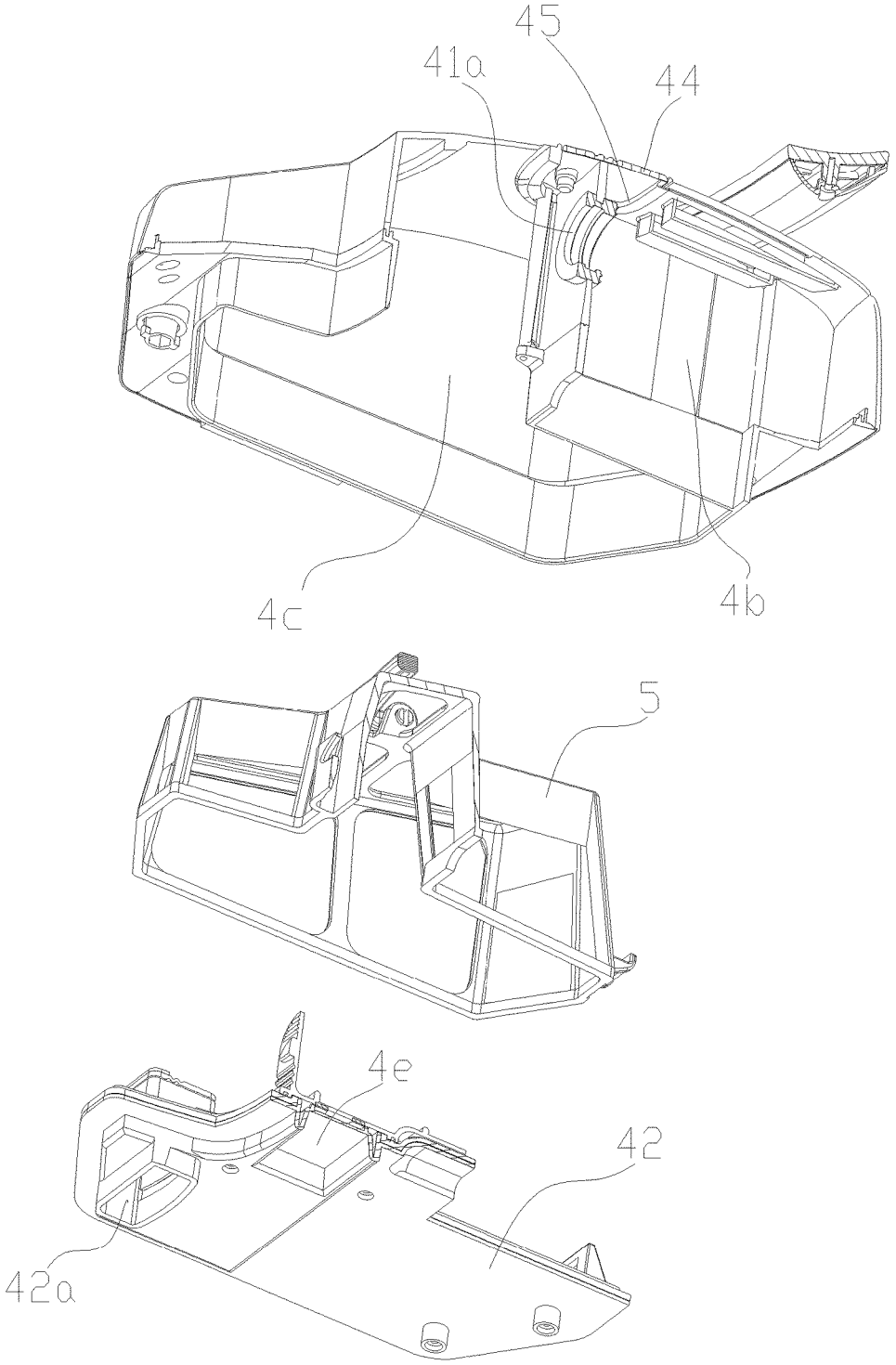
FIG. 5 is the full sectional structural schematic diagram of FIG. 4.

In the embodiment, as shown in FIG. 1, FIG. 4, and FIG. 5, filtering assembly 4 includes filtering element 5, filtering cabin 4*c*, and pump cabin 4*b*. Filtering cabin 4*c* is provided with filtering element 5. Secondary suction port 42*a* is provided in filtering element 5. Pump assembly 3 is provided in pump cabin 4*b*. Pump assembly 3 includes nozzle 32. Nozzle 32 is provided with a channel which is associated with the pump impeller and pump cabin 4*b*. Filtering assembly 4 is provided with outlet 45 which is associated with pump cabin 4*b* and the outside. The sewage enters filtering element 5 through secondary suction port 42*a*. Particle dirt is blocked within filtering element 5. The treated water penetrates filtering element 5. The treated water enters pump assembly 3 through secondary pump port 41*a*, and is discharged into pump cabin 4*b* through nozzle 32, and then is discharged into the pool through outlet 45.

In the embodiment, as shown in FIG. 3, FIG. 4, and FIG. 5, filtering assembly 4 includes supporting plate 42 and upper housing 41. Secondary suction port 42*a* is provided on the body of supporting plate 42. Upper housing 41 covers filtering cabin 4*c* and pump cabin 4*b*. The edge contour of supporting plate 42 is the same as the lower edge contour of upper housing 41. Supporting plate 42 is clamped at the lower edge of upper housing 41. Supporting plate 42 and upper housing 41 collectively form filtering cabin 4*c*. Secondary suction port 42*a* is associated with the internal cavity of filtering element 5.

In the embodiment, as shown in FIG. 2 and FIG. 3, filtering assembly 4 includes positioning concave 4*e*. Positioning concave 4*e* is provided in the lower end face of filtering assembly 4. Chassis 1 includes positioning convex 1*b*. Positioning convex 1*b* is provided on the upper end face of chassis 1. Positioning convex 1*b* is provided in positioning concave 4*e*. Positioning convex 1*b* and positioning concave 4*e* are embedded with magnets with opposite polarities. On one hand, by aligning positioning concave 4*e* and positioning convex 1*b*, filtering assembly 4 can be mounted on chassis 1 precisely. On the other hand, due to the attraction between the magnets, secondary suction port 42*a* can be firmly put against primary suction port 1*a*.

In the embodiment, as shown in FIG. 1 and FIG. 5, filtering assembly 4 includes valve plate 44. Valve plate 44 covers outlet 45. Valve plate 44 is rotatably connected to filtering assembly 4. Valve plate 44 ensures the unidirectional flow of water, that is, the water can only be discharged from filtering assembly 4, preventing outside impurities from entering reversely.

In the embodiment, as shown in FIG. 2, filtering assembly 4 includes a plurality of wings 46, the plurality of wings 46 are provided on both sides of filtering assembly 4. The plurality of wings 46 can ensure that the underwater cleaning robot will not be rushed wobbly by the water flow during its underwater movement.

In the embodiment, filtering assembly 4 includes handle 43 which is provided on the top of filtering assembly 4. Handle 43 and chassis 1 are provided at an angle of 15° to 50°. Handle 43 inclines backward. When the underwater cleaning robot is moving underwater, inclined handle 43 can turn the horizontal force of the water flow into downward pressure on the underwater cleaning robot, enhancing the moving stability of the underwater cleaning robot, so as to prevent the underwater cleaning robot from floating in the process of moving.

The best embodiments of the present application are illustrated. Modifications and alternations made by ordinary persons skilled in the art will not fall out of the scope of the present application.

What is claimed is:

1. An underwater cleaning robot, comprising:

a chassis provided with a plurality of driving wheels;

wherein the chassis includes a primary suction port and a pump assembly;

the primary suction port is provided with a first channel which passes through the chassis;

the chassis is connected to a filtering assembly;

the filtering assembly includes a secondary pump port and a secondary suction port;

the pump includes a primary pump port which is associated with a pump impeller;

the secondary pump port is connected to the primary pump port;

the secondary suction port is connected to the primary suction port;

wherein the chassis includes a brush, the brush has a V-shape, and the brush is provided behind the primary suction port;

wherein the chassis includes a console provided lengthways;

the console is electrically connected to the pump assembly and a power supply;

the filtering assembly includes a notch which is in a U-shape; and the console is provided in the notch.

2. The underwater cleaning robot according to claim 1, wherein the filtering assembly includes a filtering element, a filtering cabin, and a pump cabin;

the filtering cabin is provided with the filtering element;

the secondary suction port is positioned in the filtering element;

the pump assembly is provided in the pump cabin;

the pump assembly includes a nozzle;

the nozzle is provided with a second channel which is associated with the pump impeller and the pump cabin;

the filtering assembly is provided with an outlet which is associated with the pump cabin and outside.

3. The underwater cleaning robot according to claim 2, wherein the filtering assembly includes a supporting plate and an upper housing;

the secondary suction port is provided on a body of the supporting plate;

the upper housing covers the filtering cabin and the pump cabin;

an edge contour of the supporting plate is the same as a lower edge contour of the upper housing;

the supporting plate is clamped at a lower edge of the upper housing.

4. The underwater cleaning robot according to claim 3, wherein the filtering assembly includes a positioning concave;

the positioning concave is provided in a lower end face of the filtering assembly;

the chassis includes a positioning convex;

the positioning convex is provided on an upper end face of the chassis;

the positioning convex is provided in the positioning concave; and the positioning convex and the positioning concave are embedded with magnets with opposite polarities.

5. The underwater cleaning robot according to claim 4, wherein the filtering assembly includes a valve plate, the valve plate covers the outlet, and the valve plate is rotatably connected to the filtering assembly.

6. The underwater cleaning robot according to claim 5, wherein the filtering assembly includes a plurality of wings, the plurality of wings is provided on both sides of the filtering assembly.

7. The underwater cleaning robot according to claim 6, wherein the filtering assembly includes a handle which is provided on top of the filtering assembly.

8. The underwater cleaning robot according to claim 7, wherein the handle and the chassis are provided at an angle of 15° to 50°.

* * * * *